United States Patent [19]

Breeden

[11] Patent Number: 4,475,442

[45] Date of Patent: Oct. 9, 1984

[54] POWER TRANSMISSION

[75] Inventor: Robert H. Breeden, Metamora, Mich.

[73] Assignee: Vickers, Incorporated, Troy, Mich.

[21] Appl. No.: 346,564

[22] Filed: Feb. 8, 1982

[51] Int. Cl.[3] ..... F15B 11/08

[52] U.S. Cl. ..... 91/461; 91/446; 60/461

[58] Field of Search ..... 91/4 R, 455, 446, 461, 91/454; 60/461, 484, 452; 137/596.15

[56] References Cited

U.S. PATENT DOCUMENTS

| | | | |
|---|---|---|---|
| 2,816,420 | 12/1957 | Walsh | 91/455 |
| 3,802,318 | 4/1974 | Sibbald | 91/4 R |
| 3,991,571 | 11/1976 | Johnson | 60/452 |
| 4,201,052 | 5/1980 | Breeden et al. | 60/484 |
| 4,250,794 | 2/1981 | Haak et al. | 91/454 |

*Primary Examiner*—Samuel Scott

*Assistant Examiner*—Noah Kamen

*Attorney, Agent, or Firm*—Barnes, Kisselle, Raisch, Choate, Whittemore & Hulbert

[57] ABSTRACT

A hydraulic control system comprising a hydraulic actuator having opposed openings adapted to alternately function as inlets and outlets for moving the element of the actuator in opposite directions, a pump for supplying fluid to said actuator, a pilot operated meter-in valve to which the fluid from the pump is supplied for controlling the direction of movement of the actuator, and pilot operated meter-out valves associated with each opening of the actuator for controlling the flow out of said actuator. The pressure of fluid being supplied to the actuator by the meter-in valve is sensed and caused to produce a force opposing the movement of the meter-out valve controlling flow from the actuator.

4 Claims, 2 Drawing Figures

POWER TRANSMISSION

This invention relates to power transmissions and particularly to hydraulic circuits for actuators such as are found on earth moving equipment including excavators and cranes.

BACKGROUND AND SUMMARY OF THE INVENTION

The invention more particularly relates to hydraulic systems for automatic braking of preselected braking pressures of swing devices found, for example, in excavators and cranes. Swing drives usually comprise a hydrostatic drive having a hydraulic pump and motor, and associated gearing and controls that direct the horizontal rotation of booms found on excavator and cranes.

Swing drive arrangements have utilized the control of fluid velocity or flow to the motor through a directional control valve. With velocity or flow control, the operator selects the direction and flow of fluid at system pressure.

Typically, flow control of the swing drive provide free swing or coasting of the boom on cranes. That is, in the absence of a command signal in the hydraulic system, the boom or the boom and load will coast to a stop due to frictional forces without excessive oscillation of the boom cable or the load.

Excavators are usually arranged with flow control to provide blocked center braking of the boom. That is, the boom or the boom and load will immediately decelerate to a stop in the absence of a command signal. In such use, return flow from the motor is relieved at the motor work port by a relief valve at a predetermined pressure setting. The blocked center braking allows rapid alignment of the boom and load and also provides for maintaining the boom stationary with the excavator operating on an inclined surface.

It is also desirable, under certain conditions of operation, to brake the swing drive at a preselected reduced pressure; i.e. a pressure setting below the relief valve pressure setting.

It has been found that some operators, who have had their initial training and experience on a free swing braking arrangement on cranes, express a preference for the free swing feature when confronted with the operation of an excavator provided with a blocked center braking arrangement. Conversely, some operators, who have had their initial training on an excavator with the blocked arrangement, express a preference for the blocked center arrangement when confronted with the operation of a crane with a free swing braking arrangement.

In view of the foregoing, it is an object of this invention to provide a hydraulic circuit arrangement for automatic braking at preselected pressures of swing drives wherein an operator may selectively choose, by means of a simple adjustment, a free swing braking arrangement, or reduced pressure braking anywhere between the free swing and blocked center braking arrangements.

Accordingly, there is disclosed herein a selective swing drive automatic braking arrangement for a velocity control hydraulic system.

In accordance with the invention, the velocity control braking arrangement disclosed herein comprises a hydraulic control valve system, such as disclosed in U.S. Pat. No. 4,201,052 having a common assignee with the present application, including a pilot controller, a pump, and a hydraulic actuator. The actuator includes a movable element and a pair of openings adapted to function alternately as inlets or outlets for moving the element in opposite directions. The pilot controller supplies fluid to the system at pilot pressure and the pump supplies fluid at pump pressure to the motor. The control system includes a line adapted for connection to each of the openings. A meter-in valve means controls fluid flow from the pump to the motor and is selectively operable by pilot pressure from the pilot controller. A meter-out valve is associated with each of the lines for controlling fluid flow from the motor. The meter-out valves are each selectively pilot operated by pilot pressure from the pilot controller. In accordance with the invention, the supply fluid being supplied to the actuator is applied, at a predetermined pressure, to the meter-out valve means controlling flow from the actuator in opposition to the pilot pressure which tends to open the meter-out valve means.

DESCRIPTION

Figure 1:
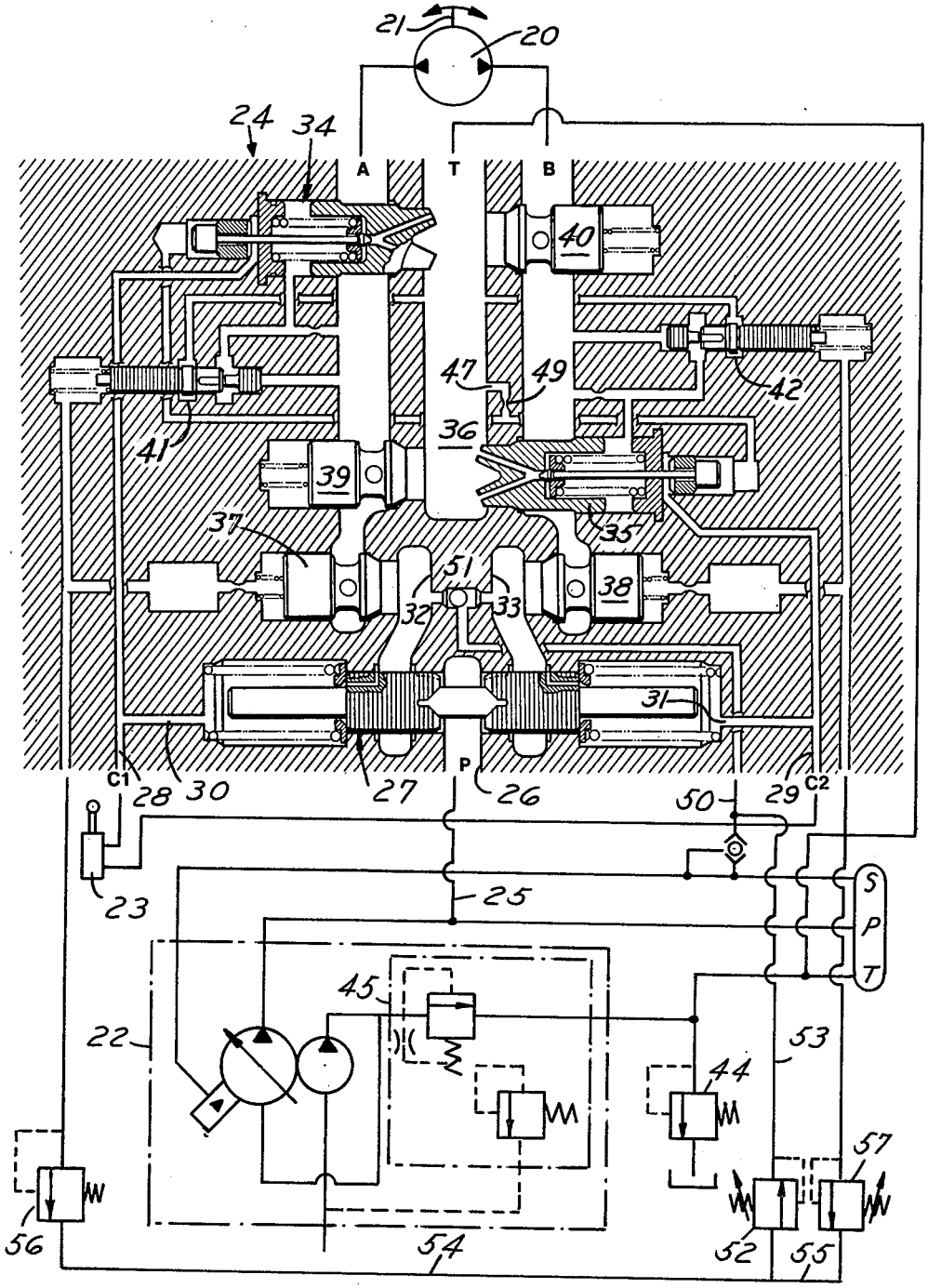
FIG. 1 is a partly diagrammatic view of a hydraulic circuit embodying the invention.

Referring to FIG. 1, the hydraulic system embodying the invention comprises an actuator 20, herein shown as a rotary hydraulic actuator, having an output shaft 21 that is moved in opposite directions by hydraulic fluid supplied from a variable displacement pump system 22 which has load sensing control in accordance with conventional construction. The hydraulic system further includes a manually operated controller 23 that directs a pilot pressure to a valve system 24 for controlling the direction of movement of the actuator, as presently described. Fluid from the pump 22 is directed to the line 25 and line 26 to a meter-in valve spool 27 that functions to direct and control the flow of hydraulic fluid to one or the other end of the actuator 20. The meter-in valve spool 27 is pilot pressure controlled by controller 23 through lines 28, 29 and lines 30, 31 to the opposed ends thereof, as presently described. Depending upon the direction of movement of the valve, hydraulic fluid passes through lines 32, 33 to one or the other end of the actuator 20.

The hydraulic system further includes a meter-out valve 34, 35 associated with each end of the actuator in lines 32, 33 for controlling the flow of fluid from the end of the actuator to which hydraulic fluid is not flowing from the pump to a tank passage 36, as presently described.

The hydraulic system further includes spring loaded poppet or drop check valves 37, 38 in the lines 32, 33 and spring-loaded anti-cavitation valves 39, 40 which are adapted to open the lines 32, 33 to the tank passage 36. In addition, spring-loaded poppet valves 41, 42, are associated with each meter-out valve 34, 35 acting as pilot operated relief valves. A bleed line 47 having an orifice 49 extends from passage 36 to meter-out valves 34, 35.

The system also includes a back pressure valve 44 associated with the return or tank line. Back pressure valve 44 functions to minimize cavitation when an overrunning or a lowering load tends to drive the actuator down. A charge pump relief valve 45 is provided to take excess flow about the inlet requirements of the pump 22 and apply it to the back pressure valve 44 to augment the fluid available to the actuator.

Meter-in valve comprises a bore in which a spool 27 is positioned and the absence of pilot pressure maintained in a neutral position by springs. The spool normally blocks the flow from the pressure passage 26 to the passages 32, 33. When pilot pressure is applied to either passage 30 or 31, the meter-in spool is moved in the direction of the pressure until a force balance exists among the pilot pressure, the spring load and the flow forces. The direction of movement determines which of the passages 32, 33 is provided with fluid under pressure from passage 26.

When pilot pressure is applied to either line 28 or 29, leading to meter-out valves 34 or 35, the valve is actuated to throttle flow from the associated end of actuator 20 to tank passage 36.

It can thus be seen that the same pilot pressure which functions to determine the direction of opening of the meter-in valve also functions to determine and control the opening of the appropriate meter-out valve so that the fluid in the actuator can return to the tank line.

Provision is made for sensing the maximum load pressure in one of a multiple of valve systems 24 controlling a plurality of actuators and applying that higher pressure to the load sensitive variable displacement pump 22. Each valve system 24 includes a line between lines 32, 33 having a shuttle valve 50 therein that receives load pressure from one of the adjacent passages 32, 33. Shuttle valve 50 senses which of the pressures is greater and shifts to apply the higher pressure to pump 22. Thus, each valve system in succession incorporates another shuttle valve 51 which compare the load pressure therein with the load pressure of an adjacent valve system and transmit the higher pressure to the adjacent valve system in succession and finally apply the highest load pressure to pump 22.

The above described circuit is shown and described in the aforementioned U.S. Pat. No. 4,201,052. The single meter-in valve 27 may be replaced by two meter-in valves.

The details of the preferred construction of the elements of the hydraulic circuit are more specifically described in the aforementioned U.S. Pat. No. 4,201,052 which is incorporated herein by reference.

In accordance with the invention, when the meter-in valve spool 27 is operated to provide supply pressure to one of the openings of the actuator, the supply pressure is also applied to prevent venting of the spring loaded poppet valves 41, 42 which serve as relief valves for meter-out valves 34, 35. As shown in FIG. 1, an adjustable relief valve 52 is connected by line 53 through lines 54, 55 having check valves 56, 57 therein to the poppet valves 41, 42 that control the meter-out valves 34, 35.

When an operator commands an output pressure or flow by introducing pilot pressure at C1 from a remotely located hydraulic remote control, for example, to shift the meter-in spool of meter-out valve 27 to the right, FIG. 1, and fluid would flow from "P" to acutator Port "B". The pilot pressure would also cause meter-out valve 34 to open permitting flow out of the actuator. The load would be accelerated up to a speed determined by the level of pilot pressure. When the operator desires to stop the load, he removes the pilot pressure at "C1" by centering the hydraulic remote control. The flow being supplied to the chamber between the meter-in valve spool 27 and the load check valve 38 for cylinder Port "B" will cease and the chamber will be allowed to drain through pilot line C2. The spring chamber of the pilot relief valve 52 will be at low pressure. The relief valve 52 will establish a back pressure acting on the balance piston of poppet valves 41 or 42, and will allow the pilot piston to open, thereby allowing the meter-out element 34 or 35 to function as a relief valve for application of load pressure at Port "A" or "B".

When a high inertia load has been accelerated up to full speed by flow supplied from Port "B", and the command at C1 ceases, the load will tend to keep running and cause flow into Port "A". The balance piston of poppet valves 41 will be allowed to open at a pressure determined by the pilot relief valve 52 which drains into the chamber between the meter-in valve 27 and "B" port load check valve 37.

Figure 2:
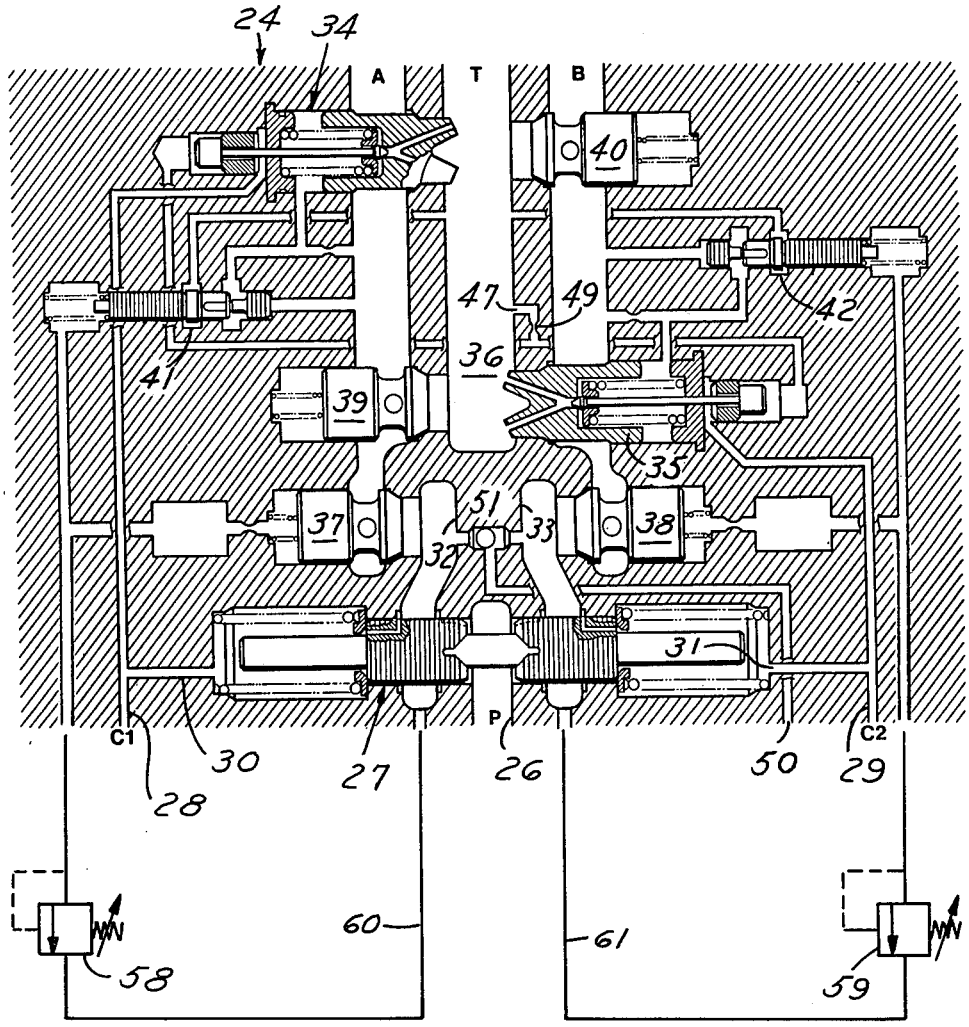
FIG. 2 is a partly diagrammatic view of a modified form of hydraulic system.

In accordance with the invention as shown in FIG. 2, adjustable relief valves 58, 59 are provided in lines 60, 61, respectively, extending from their respective chambers 32, 33, respectively.

The level of braking pressure can be preselected by adjusting the spring force of the relief valves. The range can be from very low pressure, or free coast, up to the maximum relief valve setting. When a load is being driven and pressure is present in the chamber between the meter-in spool and the load check, the additional relief valve will not function.

Although the invention is especially applicable to a hydraulic circuit utilizing pilot operated meter-in and meter-out valves; it may also be utilized with manually operated, mechanically operated or electrically operated valves. Also, the system can be applied to loads other than swing drives such as vehicle propulsion drives and winch drives.

What is claimed is:

1. A hydraulic control system comprising a hydraulic actuator having an element and opposed openings adapted to alternately function as inlets and outlets for moving the element of the actuator in opposite directions, a pump for supplying fluid to said actuator, pilot operated meter-in valve means to which the fluid from the pump is supplied, said meter-in valve means being pilot controlled by alternately supplying fluid at pilot pressure to said meter-in valve means for controlling the direction of movement of the actuator, a pair of lines extending from said meter-in valve means to said respective openings of said actuator, a drop check valve in each said line, meter-out valve means associated with each opening of the actuator for controlling the flow out of said actuator, said meter-out valve means being pilot operated by the pilot pressure, a poppet valve associated with each said meter-out valve means, and relief valve means associated with said poppet valve and the supply pressure being supplied by said meter-in valve means to one of said actuator openings functioning as an inlet and operable when the meter-in valve means is returned to a neutral position due to an absence of pilot pressure thereon to cause the poppet valve of the meter-out valve, which is associated with the actuator opening functioning as an outlet, to function as a relief valve for the load pressure being built up at the actuator opening which is functioning as an outlet.

2. The hydraulic system set forth in claim 1 wherein said relief valve means comprises a single relief valve having an inlet extending to the supply fluid pressure and a pair of outlet lines extending to each of the poppet valves, respectively.

3. The hydraulic system set forth in claim 2 wherein said relief valve is adjustable.

4. The hydraulic system set forth in claim 3 including a check valve in each said outlet line.

* * * * *